United States Patent [19]

Yie

[11] Patent Number: 4,765,540

[45] Date of Patent: Aug. 23, 1988

[54] PROCESS AND APPARATUS FOR GENERATING MULTIPLE FLUID JETS

[75] Inventor: Gene G. Yie, Auburn, Wash.

[73] Assignee: Fluidyne Corporation, Auburn, Wash.

[21] Appl. No.: 52,581

[22] Filed: May 19, 1987

Related U.S. Application Data

[63] Continuation-in-part of Ser. No. 800,339, Nov. 21, 1985, Pat. No. 4,666,083.

[51] Int. Cl.[4] ..... E01B 1/00; B05B 1/34; B05B 1/14; A62B 31/02

[52] U.S. Cl. ..... 239/8; 239/396; 239/403; 239/430; 239/432; 239/467; 239/488; 239/497; 239/590.5

[58] Field of Search ..... 239/1, 8, 403, 428, 239/429, 430, 432, 433, 463, 467, 487, 488, 492, 494, 497, 590.5, 396, 397; 51/320, 439; 138/37, 40

[56] References Cited

U.S. PATENT DOCUMENTS

| | | | |
|---|---|---|---|
| 478,295 | 7/1892 | Squire et al. | 239/497 X |
| 3,424,386 | 1/1969 | Maasberg et al. | 239/429 |
| 3,972,150 | 8/1976 | Hart | 51/11 |
| 3,994,097 | 11/1976 | Lamb | 51/11 |
| 4,074,858 | 2/1978 | Burns et al. | 239/172 |
| 4,080,762 | 3/1978 | Watson | 51/439 |
| 4,125,969 | 11/1978 | Easton | 51/320 |
| 4,218,855 | 8/1980 | Wemmer | 51/439 |
| 4,449,332 | 5/1984 | Griffiths | 51/439 |
| 4,478,368 | 10/1984 | Yie | 239/430 |

FOREIGN PATENT DOCUMENTS

| | | | |
|---|---|---|---|
| 292856 | 6/1928 | United Kingdom | 239/497 |

*Primary Examiner*—Andres Kashnikow
*Assistant Examiner*—Patrick N. Burkhart
*Attorney, Agent, or Firm*—Thomas W. Speckman; Ann W. Speckman

[57] ABSTRACT

A process and apparatus for generating multiple spirally convergent/divergent fluid jet streams and an improved process and apparatus for generating particulate containing fluid jets wherein at least one discontinuity generator is provided to create fluid instabilities, enhancing entrainment and acceleration of particulates in the fluid jet stream and providing uniform distribution of accelerated particles over a large surface area.

21 Claims, 3 Drawing Sheets

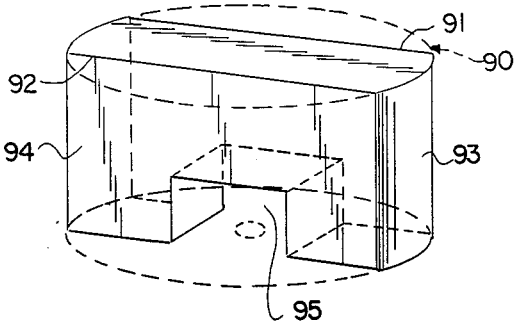
FIG. 3
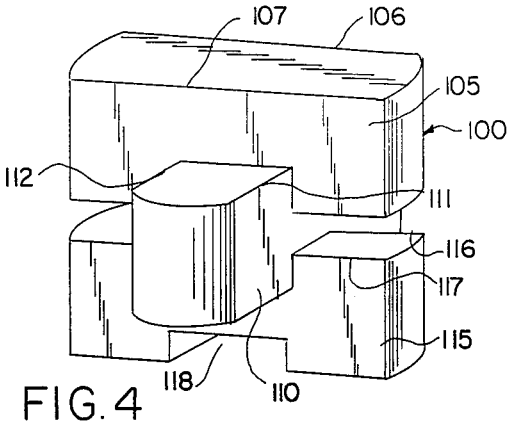
FIG. 4
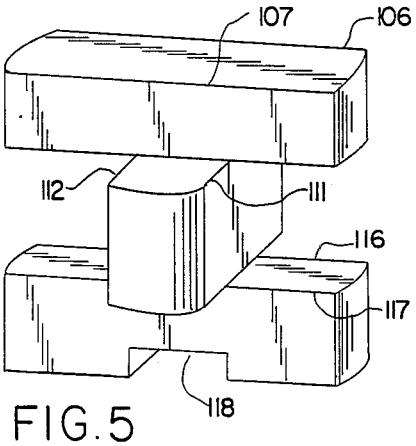
FIG. 5
FIG. 6
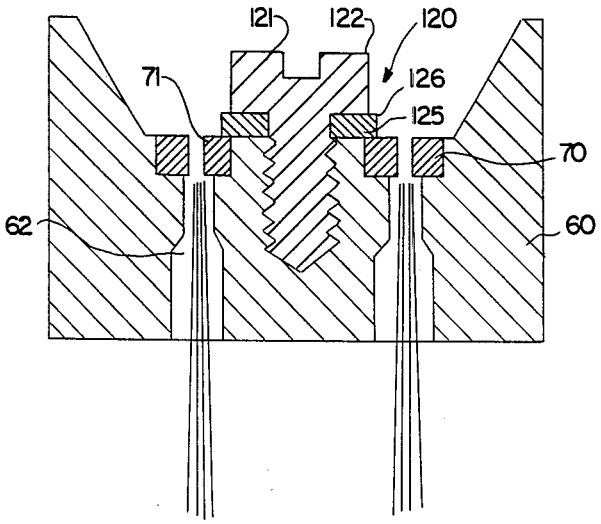
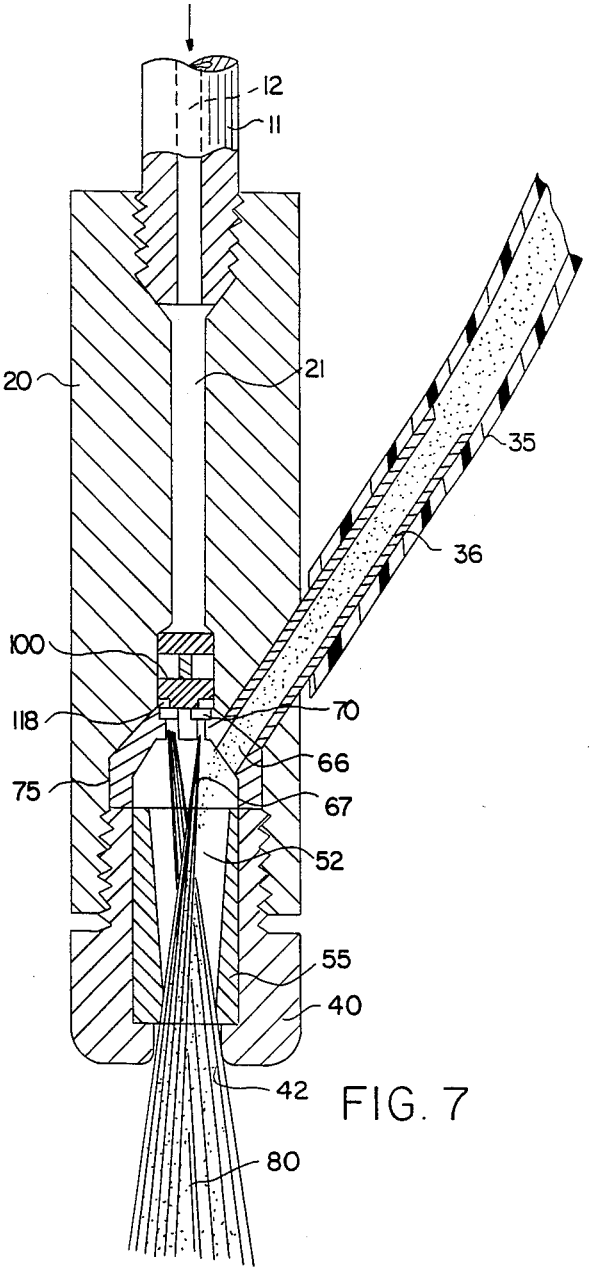
FIG. 7

PROCESS AND APPARATUS FOR GENERATING MULTIPLE FLUID JETS

CROSS-REFERENCE TO RELATED APPLICATIONS

This application is a continuation-in-part of copending U.S. patent application Ser. No. 800,339, filed Nov. 21, 1985, issuing as U.S. Pat. No. 4,666,083.

BACKGROUND OF THE INVENTION

1. Field of the Invention

This invention relates to a process and apparatus for generating multiple fluid jet streams, and an improved process and apparatus for introducing solid particulates into at least one highly pressurized fluid stream to produce a high pressure particulate containing fluid jet which is suitable for many cutting and cleaning applications.

2. Description of the Prior Art

Fluid jets are commonly generated by pressurizing fluids with a suitable pump and ejecting the pressurized fluid through a nozzle means. The water jets thus generated are useful for a wide range of applications, such as sprinkling lawns, extinguishing fires, and mining minerals. Currently, water jets generated at pressures up to 20,000 psi are routinely used in industrial cleaning, such as removing scales and deposits in exchange tubes and reactors. Water jets generated at pressures of up to 60,000 psi are used industrially to cut various materials, such as paper products, leather, polymers, plastics, textiles and asbestos products. Utilizing high pressure water jets for cutting operations is gaining popularity because of its many inherent advantages, including absence of tool contact and wear, heat and dust generation, and high speed and quality of cuts. Furthermore, the present emphasis on energy consumption and efficiency encourages the development of improved tools and methods for cutting hard materials.

The water jet cutting method has not been used widely primarily because of high equipment costs resulting from the high fluid pressure involved, high energy consumption, and the inability to cleanly cut very hard materials, such as concrete, rock, glass, hard plastics, and metals. Increasing the water pressure and thus the power input to a very high level, does not improve the quality of the cut in proportion to the costs incurred. The application of high pressure water jets to cut rock and concrete has been discussed in many publications, including: L. H. McCurrich and R. D. Browne, "Application of Water Jet Cutting Technology to Cement Grouts and Concrete"; Paper G-7, 1st International Symposium on Jet Cutting Technology, Coventry, U.K., April 1972; A. G. Norsworthy, U. H. Mohaupt and D. J. Burns, "Concrete Slotting with Continuous Water Jets at Pressures up to 483 MPa", Paper G-3, 2nd International Symposium on Jet Cutting Technology, Cambridge, U.K., April 1974; and T. J. Labus and J. A. Hilaris, "Highway Maintenance Application of Jet Cutting Technology", Paper G-1, 4th International Symposium on Jet Cutting Technology, Canterbury, U.K., April, 1978. A high pressure pulsed water jet apparatus and process is taught by U.S. Pat. No. 4,074,858.

Particulate streams comprising abrasive particles propelled by compressed air have been used to cut and/or abrade many hard materials. This particulate containing stream is quite effective when the abrasive particles are accelerated to a high velocity and ejected through a suitable nozzle. The difficulty in containing the particles and dust generated during the cutting operation, however, prohibits the large industrial scale use of particulate containing air jets.

The combination of solid particulates with a high pressure fluid jet has been utilized for several purposes. For example, U.S. Pat. No. 2,821,396 teaches solid particles in an air or steam injector as an attrition impact pulverizer; U.S. Pat. No. 3,424,386 teaches mixing of granular solids with a liquid for use in sandblasting; U.S. Pat. Nos. 3,972,150 and 3,994,097 teach water jets having particulate abrasives for cleaning with water pressures under 5000 psi; U.S. Pat. No. 4,080,762 teaches a fluid and abrasive jet for paint removal with fluid pressures up to 30,000 psi; and U.S. Pat. No. 4,125,969 teaches a wet abrasion blast cleaning apparatus and method utilizing soluble abrasive materials. U.S. Pat. No. 4,449,332 teaches a nozzle holder for dispensing a water jet containing particulate abrasive material which may be used for cutting or cleaning applications. The nozzle assembly is capable of withstanding high liquid pressures of between about 10,000 to about 50,000 psi.

U.S. Pat. No. 4,478,368 teaches a high velocity particulate containing fluid jet apparatus and process providing improved fluid jet quality by utilizing multiple fluid jets and flow shaping construction. This patent also teaches the supply of solid particulates in a foam for mixture with the fluid jet stream to minimize energy loss of the fluid jet stream and provide better control of the introduction of solid particulates into the fluid stream. Very hard materials, such as concrete, rock, glass and metals, may be cut using fluid jets containing abrasive particulates which have been generated at fluid pressures of up to 60,000 psi. For example, glass can be cut into complicated shapes with abrasive fluid jets when very hard abrasives, such as garnets, are used. Fluid jets containing abrasive particulates may be utilized to make many different types of cuts. The kerf produced by a suitable abrasive water jet nozzle may be as narrow as less than 0.05 inch or as wide as more than 1.0 inch.

In these types of particulate containing fluid jet generators, the factor which determines the cutting capabilities of the abrasive fluid jet is the efficiency of the nozzle assembly in accelerating the particulates in the fluid jet for cutting applications. It is desirable that the velocity of the abrasive fluid jet as it exits the nozzle is as high as possible, and that all particulates introduced be accelerated to a very high speed. It is preferred, in these types of abrasive fluid jet generators, that all fluid and particulate chamber walls have smooth surfaces to minimize fluid turbulence. Mixing of abrasive particulates into a highly pressurized, coherent fluid jet is very difficult to achieve.

There are also applications in which it is desirable for the fluid jet to provide uniform dispersal of fluid, with or without particulates, over a relatively large surface area. Such applications include cleaning of large surface areas and spraying to disperse fluids or solid particulate agents, such as solid insecticides. In these types of applications, it is desirable that the fluid jet be distributed uniformly and evenly over a large surface area. Fluid distribution over a large surface area is generally achieved by the use of numerous orifices. Fluid jet nozzles having numerous oval orifices have been used to generate fan-shaped fluid jet streams. Fluid jet nozzles having a plurality of round orifices with throats designed to provide uneven drag forces are also known. Currently available fluid jet nozzles are deficient both in terms of speed of application and uniformity of fluid and particulate distribution. Known fluid jet nozzles are also unacceptable for many applications and particularly high velocity fluid jet applications, due to nozzle size constraints and the desirability of very short orifice throats and utilization of very hard orifice materials.

SUMMARY OF THE INVENTION

Accordingly, it is an object of this invention to provide a process and apparatus for generating particulate containing fluid jets in which high fluid jet velocity is maintained during and after introduction of solid particulates into the fluid jet stream.

It is yet another object of this invention to provide uniform distribution of accelerated abrasive particulates within the fluid jet stream.

Yet another object of this invention is to provide an improved apparatus for generating particulate containing fluid jets which may be adjusted to produce abrasive fluid jets having a highly concentrated and directed stream to particulate containing fluid jets for distribution of solid particulates over a large surface area, without altering the configuration of the nozzle body.

Yet another object of this invention is to provide an improved nozzle means for generating particulate containing fluid jets at fluid pressures of from a few psi to more than 60,000 psi which can accelerate particles ranging from very fine powders to coarse particulates to form a high pressure abrasive fluid jet.

It is yet another object of this invention to provide a process and apparatus for generating high velocity multiple spirally convergent/divergent fluid jet streams distributed over a large surface area.

Another object of this invention is to provide an improved fluid jet nozzle means capable of generating multiple spirally convergent/divergent fluid jets at static fluid pressures of up to 100,000 psi for use in high velocity fluid jet cleaning, abrading and blasting applications.

This invention provides a process for introducing abrasive particles into high velocity fluid jets, such as water jets, to form a high velocity particulate containing fluid jet. This invention provides apparatus to generate such high velocity particulate containing fluid jets providing uniform distribution of particulates over a large surface area. The fluid jet taught by the present invention may be either liquid or gas.

The particulate containing fluid jet generating apparatus of this invention provides pressurized fluid flow through the central portion of a nozzle and particulate introduction peripherally. This design is advantageous since the fluid flow is not disturbed and the peripheral portion of the nozzle may be readily adapted to accommodate a wide variety of particulate requirements. The devices of this invention provide improved fluid jet quality by utilizing at least one discontinuity generator to create fluid instabilities, thereby providing improved entrainment and acceleration of particulates in the fluid jet stream, and providing uniform distribution of accelerated particulates over a large surface area.

Any high velocity particulate containing fluid jet apparatus, such as those taught by U.S. Pat. Nos. 4,478,368, 4,534,427, and 4,555,872, may be adapted for use in the process of this invention, and may be modified to provide an apparatus in accordance with the present invention. The apparatus and process of this invention may also be utilized with a simplified nozzle construction, while retaining the capability of generating high velocity particulate containing fluid jets, and providing uniform distribution of accelerated particulates over a large surface area.

The high velocity particulate containing fluid jet apparatus of this invention preferably utilizes a simple fluid jet nozzle construction, comprising a nozzle body having a central cylindrical chamber capable of withstanding high fluid pressure, a fluid inlet at one end of the cylindrical chamber, at least one discontinuity generator at the other, downstream end of the fluid chamber, an orifice means retained within a nozzle extension and mated with the downstream end of the cylindrical chamber to form a tight pressure seal, the other end of said orifice means in communication with one end of a mixing chamber, a peripheral particulate inlet passage intercepting the mixing chamber, a flow shaping cone having a tapered central passage in communication with the downstream end of the mixing chamber, a cylindrical central passage at the downstream end of the flow shaping cone, and a nozzle cap retaining the tapered flow shaping cone.

The discontinuity generator is positioned upstream from the orifice means and from the introduction of particulates into the fluid jet stream and it may take many forms. Any discontinuity generator means which disrupts the flow of the pressurized fluid jet or intercepts the flow of the fluid jet with a tortuous pathway, generates eddys, cavitation discontinuities, or fluid instabilities may be utilized with the process and apparatus of this invention. Discontinuity generators which have smooth surfaces and sharp, angular edges are preferred. The discontinuity generator is arranged at the downstream end of the high pressure fluid chamber and upstream from, but near the orifice means. The discontinuity generator must be positioned near the orifice means so that the fluid disruptions, eddys, cavitation discontinuities, and instabilities are not dissipated or reduced in intensity when they reach the orifice means. The extent of the fluid jet discontinuity and/or the size of the droplets generated can be adjusted by changing the geometry of the discontinuity generator, for example by varying the number and arrangement of sharp angular edges, and by changing the position of the discontinuity generator with respect to the orifice means inside the nozzle body. Despite the formation of discontinuities in the fluid jet stream, and the formation of fluid droplets, the velocity of the fluid jet stream may be maintained at a very high level by using orifice means of high precision and smoothness positioned properly relative to the discontinuity generator.

Many different types of discontinuity generators may be utilized with the process and apparatus of this invention. For example, the discontinuity generator may comprise a simple sharp-edged metal plate placed in the downstream end of the high pressure fluid chamber. To provide additional sharp angular edges and thereby further disrupt the fluid jet flow, two or more plates may be stacked on top of one another in different orientations. The plates may be stacked on top of each other, or may be provided with mating cutouts so that each individual plate meshes with the adjacent plate or plates. A discontinuity generator may also be provided in the form of a retaining bolt and washer having sharp edges, the retaining bolt additionally serving to fasten the orifice plate or plates in recesses of the orifice cone. A combination of discontinuity generators may be utilized to enhance disturbance of the fluid jet stream. For most applications, it is preferred that the sharp, angular edges of the discontinuity generator form right angles. In general, the more angular sharp-edged surfaces, the greater is the disturbance of the fluid jet stream. For different applications, characteristics of the high velocity particulate containing fluid jet, such as intensity, effective surface area of application, etc., may be readily and conveniently modified.

One embodiment of the present invention utilizes multiple high precision orifices having a spirally convergent/divergent fluid jet arrangement to generate multiple fluid jets in a spirally convergent/divergent pattern with respect to the central longitudinal axis of the nozzle body. According to this embodiment, at least two fluid jet orifices are positioned in a circular arrangement with equal angular spacing. Each fluid jet orifice is oriented at a compound angle having a spiral component and a convergent component with respect to the central longitudinal axis of the orifice cone, so that the multiple fluid jets converge to a tangential circle, but do not intercept one another. This embodiment of the present invention may be used to generate high velocity fluid jets, with or without particulates, and is particularly suitable for applications requiring impingement of fluid jet streams over a relatively large surface area.

Suitable particulates, suitable fluid streams including both liquid and gas streams, and suitable materials of construction for the various elements are known and have been described in U.S. Pat. No. 4,478,368. The solid particulates supplied to the central fluid jet passage through the particulate feed tube may be supplied in a foam, a slurry, a gaseous stream, or in any other form suitable for mixture with a fluid jet stream or streams. The solid particulates utilized for the process and apparatus of this invention may range in size from very fine, powdery solid particles, to coarse granular solid particles. Especially suitable solid particulates for use in this invention include abrasives such as silicon carbide, aluminum oxide, garret, silica sand, steel shots, metallic slag, glass beads, crushed walnut shells, corncobs or oat husks, and the like.

The process and apparatus of this invention may be used for generating fluid jet streams and mixing solid particulates with fluid streams of liquid or gas for any desired purpose. For example, in addition to cutting, abrading, and blasting operations, the solid particles may comprise ground coal or other fuel, and the fluid may comprise natural gas or fuel oil, the nozzle assembly generating a stream of the solid containing fluid mixture for combustion purposes.

The orifice means utilized with the process and apparatus of this invention may have a single, centrally arranged orifice, or it may comprise any number and arrangement of orifices to enhance the mixing of abrasive particulates with the fluid jet stream. The orifice cones utilized in this invention may be drilled to provide fluid orifices, or they may accommodate separate orifice plates set in retaining receptacles in the orifice cones. As taught in U.S. Pat. Nos. 4,478,368, 4,534,427 and 4,555,872, multiple orifices may be positioned in a circular pattern with equal angular spacing in the orifice cone. Multiple orifices may be directed parallel to one another and to a central axis to generate parallel fluid jet streams, the orifices may be oriented to generate converging or diverging fluid jet streams, or the orifices may be arranged to generate spirally convergent/divergent fluid jet streams. Similarly, as taught by U.S. Pat. Nos. 4,478,368, 4,534,427 and 4,555,872, multiple abrasive orifices may be provided for better mixing of the abrasive particulates with the fluid jet stream.

BRIEF DESCRIPTION OF THE DRAWING

Specific embodiments of the apparatus of this invention are shown in the drawing wherein:

FIG. 3 shows a perspective view of a discontinuity generator in accordance with this invention;

FIGS. 4 and 5 show perspective views of multiple element discontinuity generators suitable for use with this invention;

FIG. 6 shows a cross-sectional view of another suitable discontinuity generator;

FIG. 7 shows a partial cross-sectional view of a simplified particulate containing fluid jet nozzle assembly according to this invention, which is especially suitable for forming spirally divergent particulate containing fluid jets providing uniform distribution of particulates over a large surface area;

DESCRIPTION OF PREFERRED EMBODIMENTS

According to one embodiment, the process of this invention involves producing a particulate containing fluid jet stream by forming at least one high pressure fluid jet stream, passing the high pressure fluid jet stream through a high pressure fluid chamber wherein a suitable discontinuity generator is arranged thereby causing turbulence in the fluid jet stream, passing the turbulent fluid jet stream through at least one orifice means, introducing solid particulates peripheral to the fluid jet stream, mixing the solid particulates with the fluid jet stream, and passing the mixed solid particulate fluid jet stream through a converging flow shaping nozzle. Provision of a discontinuity generator upstream from but near the fluid jet orifice means and upstream from particulate introduction, is an important aspect of the process and apparatus of this invention. The discontinuity generator creates turbulence in the high pressure fluid jet stream, the turbulence is amplified as the fluid jet stream passes through the orifice, and the mixing of particulates in the fluid jet stream is significantly improved.

Another embodiment of the process and apparatus of the present invention provides for generation of multiple fluid jet streams which, according to a preferred embodiment, are arranged in a spirally convergent/divergent pattern with respect to the central axis of the nozzle assembly. Generation of spirally convergent/divergent fluid jet streams is useful for many applications, with or without particulate introduction, and with or without provision of a discontinuity generator.

Figure 1:
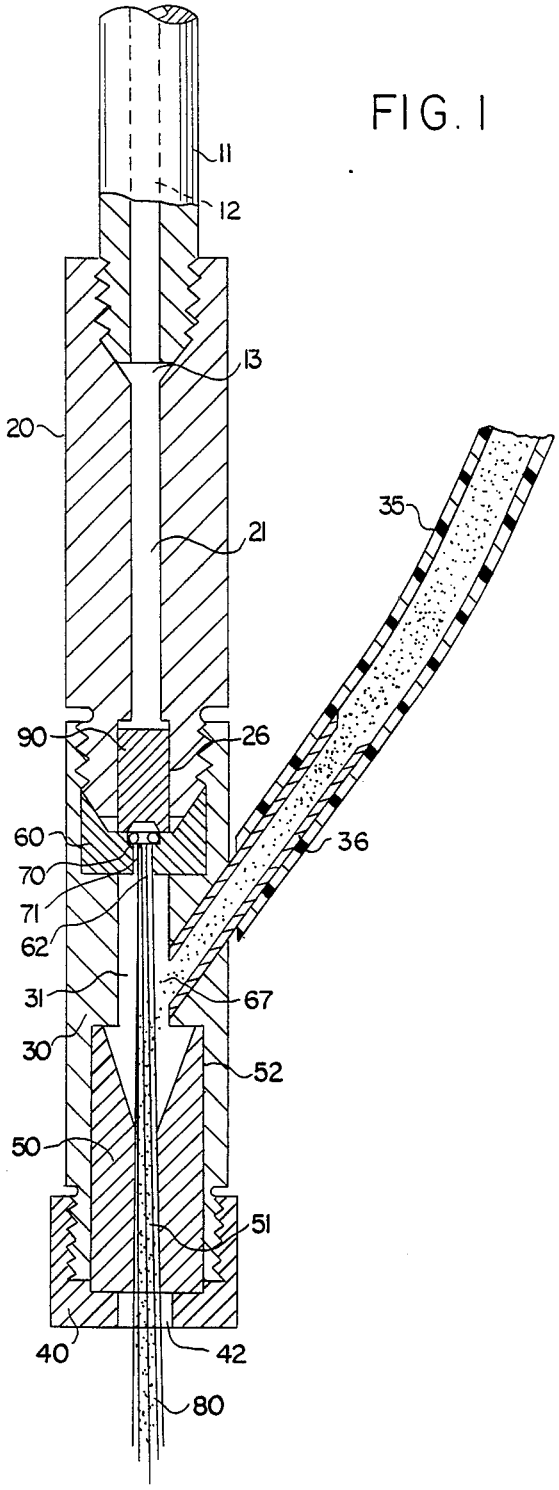
FIG. 1 shows a partial cross-sectional view of a simplified particulate containing fluid jet nozzle assembly according to one embodiment of this invention.

FIG. 1 shows one embodiment of an improved particulate containing fluid jet apparatus according to this invention. Pressurized fluid is introduced to the nozzle assembly through passage 12 of pressurized fluid inlet tube 11. Pressurized fluid inlet tube 11 is securely retained on nozzle body 20 with mating screw threads, as shown in FIG. 1, or by any other means known to the art which provides a gas-tight and liquid-tight seal. All internal passages of the fluid jet nozzle assembly must be capable of withstanding high fluid pressures of from about a few psi to about 60,000 psi. The pressurized fluid jet stream passes from passage 12 through fluid inlet 13 into pressurized fluid chamber 21, which is preferably cylindrical and centrally arranged within nozzle body 20. Disposed in the opposite, downstream end of pressurized fluid chamber 21 is a fluid stream discontinuity generator 90 arranged within discontinuity generator chamber 26. Discontinuity generator chamber 26 is preferably cylindrical, and it may be larger in diameter than pressurized fluid chamber 21, as shown in FIG. 1. Alternatively, discontinuity generator chamber 26 may be an extension of pressurized fluid chamber 21, having the same diameter as fluid chamber 21. Discontinuity generator 90 is securely retained within chamber 26 to prevent any movement of the discontinuity generator caused by turbulence of the pressurized fluid, but the discontinuity generator may be easily removed and/or replaced upon disengagement of nozzle body 20 from nozzle extension 30. Similarly, a discontinuity generator may easily be inserted in the downstream portion of the pressurized fluid chamber of existing fluid jet generating apparatus, providing additional capabilities.

Discontinuity generator 90, as shown in FIG. 1, is a single piece, plate-type discontinuity generator, and is shown more clearly in FIG. 3. The purpose of the discontinuity generator is to subject the fluid jet stream to sharp, angular edges, to create a tortuous pathway and to disrupt the fluid jet stream and create turbulence. Discontinuity generator 90 may comprise a metal plate having sharp, right angled edges 91 and 92 to create turbulence in the fluid jet stream, and curved side walls 93 and 94 which conform to and abut the inner walls of cylindrical chamber 26. It may be machined from a cylindrical component, as indicated by the dashed lines in FIG. 3. Discontinuity generator 90 is preferably machined with precision to provide sharp edges and to provide a tight fit within chamber 26. Discontinuity generator 90 is additionally provided, at its bottom surface adjacent the orifice means, with a cutout portion 95. Cutout portion 95 may be rectangular, as shown in FIG. 3, or the side walls of cutout portion 95 may be oblique, as shown in FIG. 1. Cutout portion 95 is substantially larger in cross section than the orifice means, positioned immediately downstream and centrally with respect to cutout portion 95. Preferred dimensions of passages, orifice and discontinuity generators are known to the art, or may be determined upon routine experimental investigation.

The turbulent pressurized fluid jet stream is forced into the cutout portion 95 and then through an orifice means. An orifice cone may be drilled to provide fluid orifices or individual orifice plates may be retained in receptacles in an orifice support cone. As shown in FIG. 1, orifice plate 70 having central orifice 71 shaped for generating a substantially coherent fluid jet is mounted in a receptacle in orifice support cone 60. Orifice plate 70 is preferably made from a hard material, such as hardened steel, hard ceramics, tungsten carbide, diamond, aluminum oxide, ruby or sapphire. Orifice plates comprising such materials have a long lifetime, withstand high fluid pressures, and can be made by methods known to the art to very high precision standards. Support cone 60 has through passage 62 aligned with and of larger diameter than orifice 71. Support cone 60 is held tightly against nozzle body 20 by nozzle extension 30 being threadedly engaged with the lower portion of nozzle body 20. A tapered fit between support cone 60 and nozzle body 20 is preferred to center support cone 60. As the fluid stream exits through passage 61 of orifice support cone 60, it passes into nozzle extension through passage 31 in nozzle extension 30. The diameter of nozzle extension through passage 31 is preferably substantially larger than the diameter of through passage 62 in orifice support cone 60.

Particulates are peripherally introduced into the turbulent fluid jet stream in mixing chamber 67, which comprises a portion of nozzle extension through passage 31. Desired particulates are supplied through particulate feed means 35 and are introduced into mixing chamber 67 through particulate feed tube 36. Solid particles may be conveyed through particulate feed means 35 and feed tube 36 in a gas stream, in a liquid slurry, or in a foam entraining the solid particulates.

Many different solid particulates may be used in the process of this invention, most suitably those having average diameters of from about 2 microns to about 1250 microns, preferably from about 10 microns to about 200 microns. Particles having a broad range of densities may be used according to this invention. Especially suitable solids for use in this invention include abrasives such as silicon carbide, aluminum oxide, garnet, silica sand, metallic slag, glass beads, crushed walnut shells, and the like, or other particulates for distribution, such as insecticides, fertilizers, coating solids, and the like. The process and apparatus of this invention may be used for mixing solid particulates with a fluid stream of liquid or gas for any desired purpose. For example, the solid particles may be ground, solid fuel and the fluid may be natural gas or fuel oil, the nozzle used to generate a particulate containing fluid jet for combustion purposes. The solid particulates may be dust generated in industrial processes and the fluid may be water, the nozzle used to generate a particulate containing fluid jet for removal of dust from gaseous streams by impingement.

Following particulate introduction to the turbulent fluid jet stream, the stream enters tapered central passage 52 of flow shaping cone 50. Cylindrical through passage 51 is centrally arranged within flow shaping cone 50 downstream from tapered central passage 52. Flow shaping cone 50 may be securely retained within nozzle extension 30 by nozzle cap 40 being threadedly engaged with the lower portion of nozzle extension 30, or it may fit loosely within nozzle extension 30 to provide for self-alignment with the particulate containing fluid jet stream. Nozzle cap 40 has a centrally arranged passage 42 which is preferably larger in diameter than through passage 51 in flow shaping cone 50. High velocity particulate containing fluid jet 80 exits the fluid jet apparatus through passage 42.

Figure 2:
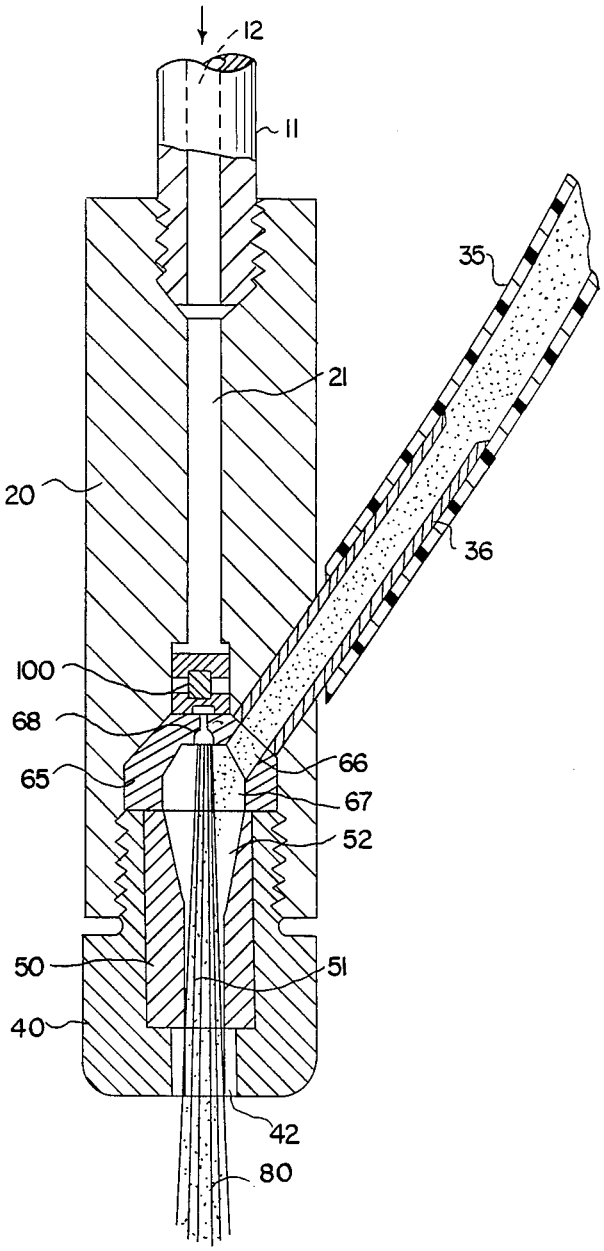
FIG. 2 shows a partial cross-sectional view of another embodiment of a simplified particulate containing fluid jet nozzle assembly of this invention.

FIG. 2 shows another simplified embodiment of a high velocity particulate containing fluid jet apparatus. Nozzle cap 40 is screwedly engaged with nozzle body 20, thus eliminating nozzle extension 30. The embodiment shown in FIG. 2 also utilizes a different type of discontinuity generator, shown more clearly as three element discontinuity generator 100 in FIG. 4. Three element discontinuity generator 100 comprises first element 105, second element 110, and third element 115. First element 105 and third element 115 are parallel to and aligned with one another, and second element 110 is arranged perpendicular to the first and third elements. Each element has curved side walls which conform to and abut the inner walls of cylindrical chamber 26. Each element also has sharp right-angled edges to create turbulence in a high velocity fluid jet stream. First element 105 has edges 106 and 107, second element 110 has edges 111 and 112, and third element 115 has edges 116 and 117. Each element is also provided with at least one cutout section, shown as 108, 113 and 118, respectively, to provide an interlocking fit among component elements comprising a discontinuity generator, and to provide access to the orifice means.

Another embodiment of a three element discontinuity generator is shown in FIG. 5, wherein the first and second elements do not have cutout portions, but are stacked atop one another. Discontinuity generators according to the present invention may comprise any number of elements stacked or set one upon another. It is preferred that the elements have sharp edges to create turbulence in a high velocity fluid stream, and provide a tortuous pathway, and that component elements are shaped to be securely retained within the cylindrical chamber. The elements may be placed at angles other than right angles to one another. A cutout portion, such as 118, is necessary in the element which is adjacent the orifice means to permit passage of the fluid jet stream through the orifice means.

As shown in FIG. 2, the configuration of an orifice cone utilized in the process and apparatus of the present invention may vary considerably. Orifice cone 65 has an inverted, generally cup-like configuration to provide mixing chamber 67 partially within an interior space formed by orifice cone 65. In this embodiment, solid particulates are delivered through particulate feed means 35 and particulate feed tube 36, and through peripheral particulate inlet 66 drilled directly in orifice cone 65. Orifice 68 is drilled directly and centrally arranged in the upper portion of orifice cone 65. It may comprise a cylindrical orifice or taper outwardly toward mixing chamber 67, or it may comprise a combination of these two forms. Tapered, upper portions of orifice cone 65 sealingly abut tapered walls of nozzle body 20, and orifice cone 65 is retained in nozzle body 20 by means of nozzle cap 40 screwedly engaged with nozzle body 20. Flow shaping cone 50 having tapered central passage 52 and cylindrical through passage 51 is retained within a cylindrical chamber in nozzle cap 40, and abuts the lower surfaces of orifice cone 65. High pressure, particulate containing fluid jet stream 80 exits the apparatus through passage 42 in nozzle cap 40.

FIG. 6 illustrates yet another embodiment of a discontinuity generator according to this invention, and utilization of multiple orifice plates in a multiple orifice cone. Discontinuity generator 120 comprises retaining bolt 121 having sharp right angled edge 122 around its perimeter. Retaining bolt 121 is screwedly engaged with orifice support cone 60, and washer 125 is preferably arranged between retaining bolt 121 and orifice support cone 60. Washer 125 preferably comprises a hard material and has sharp right angled edge 26 extending around its perimeter to act as a further discontinuity generator. Discontinuity generator 120 operates on the same principle as those described above, the sharp edges creating turbulence in the high pressure fluidized stream.

Discontinuity generator 120 may also be utilized in combination with discontinuity generator 90 or discontinuity generator 100. Discontinuity generator 90 or 100, as described above, may be positioned upstream from discontinuity generator 120, with the cutout portion of discontinuity generator 90 or 100 sized to accommodate retaining bolt 121. In another embodiment, the side walls of cutout portion 95 of discontinuity generator 90 may be curved to conform to portions of right-angled edge 122 around the perimeter of retaining bolt 121. Discontinuity generator 90 may be thereby securely retained on discontinuity generator 120 and oriented in a way which does not block the orifice means. Likewise, discontinuity generator 120 may be utilized in combination with three element discontinuity generator 100 as shown in FIGS. 4 and 5, and the side walls of cutout portion 118 may be curved to conform to portions of right angled edge 122 around the perimeter of retaining bolt 121. Discontinuity generator 100 may be thereby securely retained on discontinuity generator 120 and oriented in a way which does not block the orifice means.

Orifice support cone 60, as shown in FIG. 6, has multiple orifice plate receptacles and multiple through passages, each orifice plate 70 seated in a receptacle in orifice support cone 60. Orifices 71 of orifice plates 70 are of smaller diameter than through passages 62 in orifice support cone 60. Through passages 62 may be cylindrical or tapered for their entire length, or through passages 62 may be cylindrical, and then taper slightly to form a larger cylindrical passage, as shown in FIG. 6. Multiple fluid orifices may generate substantially parallel fluid jets, converging or diverging fluid jets, or spirally converging/diverging fluid jets, depending on the orientation of the fluid orifices with respect to the central axis of the apparatus. The orifice cones utilized in this invention may be drilled directly to provide fluid orifice means or may have separate orifice plates set in retaining receptacles in the orifice cone. Orifice cones according to the present invention may also have multiple abrasive orifices to enhance mixing of abrasive particulates with the fluid jet. Any number and combination of orifices for enhancing the desired mixing may be used. Depending upon the diameter of individual orifice means and of the orifice cone at the top, from 2 to 9 orifice means are preferred and from 3 to 6 orifice means are particularly preferred. Multiple orifice means are preferably positioned in a circular pattern with equal angular spacing in which the same number of orifices are provided for fluid and particulate streams. One particularly advantageous arrangement of multiple fluid and particulate orifices is to space the particulate orifice means on an arc midway between the fluid jet orifice means.

FIGS. 7–12 illustrate a preferred embodiment of the present invention providing multiple fluid jet streams arranged in a spirally convergent/divergent pattern with respect to the central axis of the nozzle assembly. Components of the apparatus shown in FIGS. 7–12 which correspond to previously described components of the applicant's apparatus are numbered correspondingly, and the previous description of suitable materials of construction, suitable parameters, and alternative embodiments are applicable to the embodiments shown in FIGS. 7–12.

Figure 8:
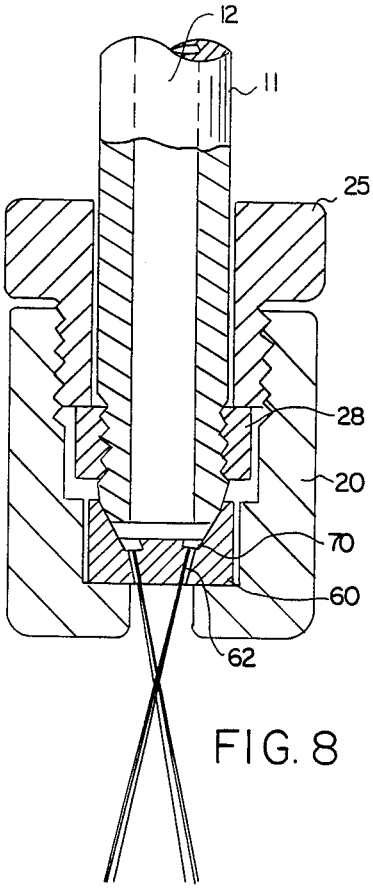
FIG. 8 shows a partial cross-sectional view of a simplified multiple fluid jet nozzle assembly having multiple spirally convergently/divergently angled orifice means.

FIG. 8 shows a fluid jet apparatus for generating high velocity fluid jet streams which is particularly suitable for use with high pressure fluids. High pressure fluid inlet tube 11 passes through a central bore of gland nut 25 mounted on nozzle body 20 and is threadedly engaged with collar 28. Feed inlet tube 11 is provided with a threaded end portion having convex terminal side walls, and orifice support cone 60 has mating concave surfaces to provide a fluid-tight seal which is capable of withstanding very high fluid pressures. Gland nut 25 and tube collar 28 provide the force necessary to form the fluid-tight convex/concave seal. A plurality of orifice plates 70 are mounted at an angle in orifice support cone 60 and through passages 62 are likewise angled to generate multiple spirally convergent/divergent fluid jet streams, as will be described below in greater detail.

Figure 9:
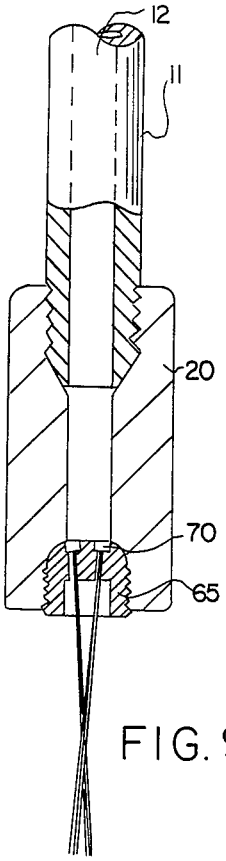
FIG. 9 shows a partial cross-sectional view of another simplified fluid jet nozzle assembly suitable for generating multiple spirally convergent/divergent fluid jet streams according to this invention.

FIG. 9 shows a simplified nozzle assembly wherein fluid inlet tube 11 is threadedly engaged with one end of nozzle body 20, while orifice support cone 65 is threadedly engaged at the other end of nozzle body 20. Orifice support cone 65 is provided with concave sealing surfaces which seal against convex surfaces of nozzle body 20. Orifice plates 70 are mounted at an angle in orifice support cone 65 to generate spirally convergent/divergent fluid jet streams which converge to a tangential circle but do not intercept one another. This embodiment is advantageous from the standpoint that it provides direct access to the orifice support cone.

Figure 10:
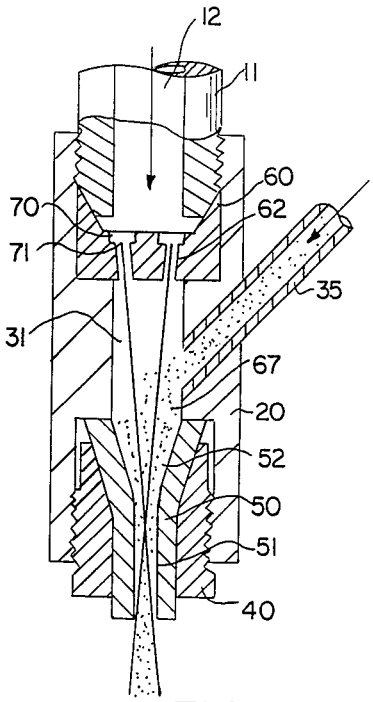
FIG. 10 shows a partial cross-sectional view of a fluid jet nozzle assembly suitable for generating multiple spirally convergent/divergent particulate containing fluid jet streams.

FIG. 10 shows an apparatus of the present invention for generating multiple spirally convergent/divergent particulate containing fluid jet streams. Fluid inlet tube 11 is threadedly engaged with nozzle body 20, and has tapered end portions which seal against tapered portions of orifice support cone 60. Multiple orifice plates 70 are mounted at an angle in orifice support cone 60 and through passages 62 are likewise angled to generate multiple spirally convergent/divergent fluid jet streams. Particulates are introduced peripherally through at least one particulate feed means 35 and are mixed with the multiple fluid jet streams in mixing chamber 67. Particulate containing fluid jet streams then pass through tapered central passage 52 and cylindrical through passage 51 of flow shaping cone 50 retained by nozzle cap 40 mounted on nozzle body 20.

FIG. 7 shows a fluid jet apparatus similar to that shown in FIG. 2, with a multiple element discontinuity generator adapted for use with multiple fluid jet orifices which are directed spirally convergently/divergently with respect to the central axis of the nozzle assembly to form multiple spirally convergent/divergent fluid jet streams. The third and lowermost element of the discontinuity generator 100 has multiple cutout portions 118 corresponding to the number and arrangement of orifice plates 70 retained in orifice cone 75.

Figure 11:
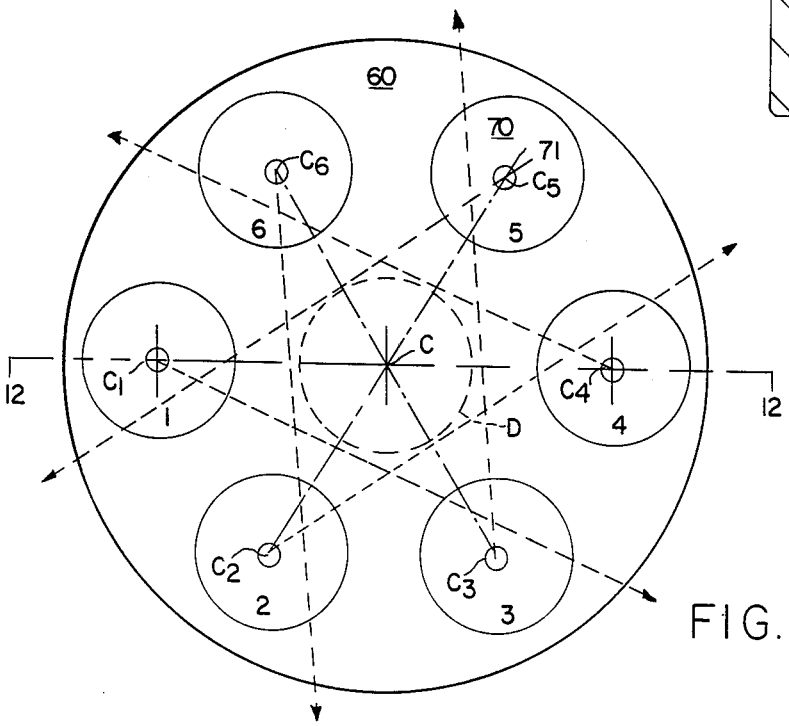
FIG. 11 shows an enlarged schematic top view of an orifice cone having multiple angled orifices and illustrating the spiral component of the angled orifice means with respect to the central longitudinal axis of the nozzle assembly.
Figure 12:
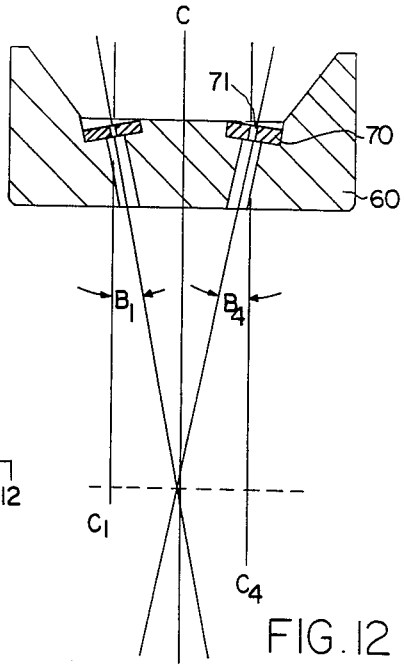
FIG. 12 shows an enlarged cross-sectional side view of the orifice cone of FIG. 11 taken along line 12—12 illustrating the convergent component of the angled orifice means with respect to the central longitudinal axis of the nozzle assembly.

The arrangement of multiple spirally convergent/divergent fluid orifice means is illustrated in FIGS. 11 and 12. Nozzle assemblies comprising from 3 to 9 fluid orifice means are preferred, and an orifice cone with six orifice means oriented spirally convergently/divergently is especially preferred for use in the embodiments of FIGS. 7–10.

FIG. 11 shows a schematic top view of six radially arranged orifice plates 70, numbered 1–6, each having a central orifice means 71 provided therethrough. FIG. 11 illustrates the spiral and convergent angular components of the compound angular arrangement of each fluid jet orifice means with respect to central longitudinal axis C of the nozzle assembly. The spiral angular component of each orifice means is directed at an acute angle to a central vertical axis of each orifice means $C_1$, $C_2$, etc. and lies in a plane perpendicular to a radial plane between the central vertical axis of each orifice means and central longitudinal axis C of the nozzle assembly. The spiral angular components of the multiple orifice means may be directed in either direction from the central vertical axes of the orifice means, but all orifice means in an orifice support cone must be angled correspondingly. The convergent angular components B of the orifice means are shown in FIG. 12 as angles $B_1$ and $B_4$. Angles $B_1$ and $B_4$ are acute angles with respect to central vertical axes $C_1$, $C_4$ of each orifice means. As shown schematically in FIG. 11, the compound angular arrangement of each fluid jet orifice means produces multiple spiral fluid jets which converge toward central axis C of the nozzle assembly to tangential circle D, and then diverge from central axis C. The diameter of tangential circle D may be increased or decreased by adjusting the spiral angular components. The spiral angular component of each angled orifice means must be greater than 0° to the central vertical axes to prevent the multiple fluid jets from intercepting one another, and is preferably at least about 5° and preferably about 5° to about 45° to prevent interference between the multiple fluid jets due to natural dispersion of the fluid jet streams. For certain applications, it may be preferred that the spiral angular components of all angled orifice means are not equal to provide a non-circular impingement pattern. The distance of tangential circle D from the angled orifice means may be increased or decreased by changing the convergent angular components B. The convergent angular component B of each angled orifice means must be greater than 0° and less than 90°, and is preferably from about 1° to about 30°. With suitable selection of the spiral and convergent angular components, multiple fluid jets issue spirally convergently/divergently and may form a large impingement circle on a target surface even though multiple orifice means are positioned very close to each other in the orifice cone. In this fashion, a very small nozzle assembly may be used to provide multiple fluid jet streams, with or without particulates, having a large impingement surface area.

The bore and position of the flow shaping cones shown in FIGS. 7 and 10 are matched to the spiral and convergent angular components of the six fluid orifices. A large bore flow shaping cone 55 is utilized in this embodiment to accommodate the convergent/divergent multiple fluid jet streams. With use of multiple high precision orifices, a spirally convergent/divergent fluid jet arrangement and a discontinuity generator, this embodiment of the particulate containing fluid jet apparatus may generate a particulate containing fluid jet capable of distributing particulates in spirally convergent-/divergent fluid jet streams uniformly over a large surface area. The spirally convergent/divergent fluid jet orifice arrangement utilized in this embodiment is also suitable for use with other orifice arrangements in other types of orifice cones.

While application of the process and apparatus of this invention has been described with respect to cutting materials, such as plastics, composites, glass, ceramics, metals, concrete and rock, and for efficient cleaning of surfaces, it is readily apparent that the process and apparatus of this invention is advantageously applicable to all stream containing a mixture of solid particulates in a fluid stream. While the fluid streams have been described as liquid streams such as water, it is readily apparent that fluid streams such as air and other gaseous fluids, may readily be used. The most advantageous distance from the particulate containing fluid jet stream nozzle to the material desired to be cut or cleaned may be readily ascertained by one using the process and apparatus of this invention.

The following examples set forth specific materials, quantities, sizes, and the like, for the purpose of more fully understanding very specific embodiments of the present invention, and are not meant to limit the invention in any way.

EXAMPLE I

For a comparative test, an apparatus for generating particulate containing fluid jets was assembled as shown in FIG. 1 without a discontinuity generator. The nozzle body was 4.5 inches long and had a fluid chamber with an inner diameter of 0.188 inch. An orifice cone having a single high precision sapphire orifice having a diameter of 0.050 inch was utilized. A tungsten carbide flow shaping cone 2 inches long was positioned 0.60 inch below the lower surface of the orifice cone. The flow shaping cone had a 60° taper to a central passage having an inner diameter of 0.25 inch.

A water jet was generated utilizing water provided to the fluid chamber at a pressure of 15,000 psi. By visual examination, the water jet was coherent. An impingement mark having a diameter of less than 0.5 inch was produced on a rusted steel plate positioned 16 inches from the tip of the apparatus. The apparatus was not capable of distributing sand particles uniformly in the water jet. The area of the steel plate cleaned by the sand containing water jet was less than 1 inch in diameter and exhibited uneveness in said distribution.

EXAMPLE II

The process and apparatus of Example I was utilized to produce a sand particle containing water jet according to the present invention with a discontinuity generator as shown in FIG. 4. The three element discontinuity generator had a diameter of 0.200 inch fitting forceably within the fluid chamber of the nozzle body. The sand containing water jet was coherent with significant dispersion of sand at the supply pressure of tap water, based upon visual examination. At 15,000 psi water pressure, the sand containing water jet thoroughly cleaned a 6 inch diameter area on the steel plate 16 inches from the nozzle with uniform distribution of said sand particles over the area.

EXAMPLE III

The process and apparatus of Example II was utilized substituting a single element discontinuity generator as shown in FIG. 3. At 15,000 psi water pressure, the sand containing water jet cleaned a 2 inch diameter area on the steel plate 16 inches from the nozzle.

The examples illustrate the versatility of the process and apparatus of the present invention and the suitability for a wide range of applications ranging from cutting to surface polishing.

EXAMPLE IV

An apparatus of the type shown in FIG. 8 was constructed for testing purposes. The fluid inlet tube had an outer diameter of 0.563 inch with an inner fluid passage having a diameter of 0.3 inch for use with liquids at pressures of up to 20,000 psi. The nozzle body had an outer diameter of 1.0 inch, a length of 1.5 inch, and was constructed of stainless steel. The orifice support cone had an outer diameter of 0.6 inch, a height of 0.4 inch, and was provided with six orifice plates mounted angularly in recesses with 60° spacing between the central vertical axes of the orifice means and a 0.10 inch radius between the central vertical axis of each orifice means and the central longitudinal axis of the nozzle assembly. The spiral angular component of each orifice means was 20° from the central vertical axis of each orifice means, and the convergent angular component of each orifice means was 5° from the central vertical axis of each orifice means. The orifice plates were constructed of synthetic sapphire with a highly polished and accurate orifice of 0.21 inch in diameter. The fluid inlet tube was connected to a 60 horsepower, 15,000 psi crankshaft pump for generating high pressure water jets. When the water pump was actuated, six spirally convergent/divergent water jets issued in a counterclockwise direction. These six spirally convergent/divergent water jets were visibly distinguishable when the water pressure was very low, but were not visibly distinguishable at water pressures of 15,000 psi. A circular impingement pattern of multiple water jets was visible when the nozzle was positioned at a distance from a dirty steel plate. At a nozzle standoff distance of about 18 inches, the diameter of the circular water jet impingement pattern was about 4 inches. The size of the impingement circle increases as the nozzle standoff distance increases.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein may be varied considerably without departing from the basic principles of the invention.

I claim:

1. A nozzle assembly apparatus for generating multiple fluid jet streams in a spirally convergent/divergent non-intercept arrangement comprising: a pressurized fluid chamber aligned with a central longitudinal axis of said nozzle assembly; at least two fluid orifice means in the downstream end of said pressurized fluid chamber, each said fluid orifice means oriented at a compound angle having a spiral angular compound and a convergent angular component with respect to said nozzle assembly central longitudinal axis, each said spiral angular component being directed in the same direction with respect to said central longitudinal axis and at an angle greater than 0° to said central longitudinal axis of said nozzle, assembly and each said convergent angular component at an angle greater than 0° and less than 90° to a central axis through the corresponding said orifice means, said spiral angular component and said convergent angular component providing non-interception of any of said multiple fluid jets and a curvilinear impingement pattern.

2. A process for generating multiple fluid jet stream in a spirally convergent/divergent non-intercept arrangement, comprising the sequential steps of:

passing a pressurized fluid jet stream through a pressurized fluid chamber aligned with a central longitudinal axis;

passing said pressurized fluid jet stream through at least two fluid orifice means in the downstream end of said pressurized fluid chamber, each said fluid orifice means oriented at a compound angle having a spiral angular component and a convergent angular component with respect to said nozzle assembly central longitudinal axis, directing each said spiral angular component in the same direction with respect to said central longitudinal axis and at an angle greater than 0° to said central longitudinal axis of said nozzle assembly, and directing each said convergent angular component at an angle greater than 0° and less than 90° to a central axis through the corresponding said orifice means, said spiral angular component and said convergent angular component providing non-interception of any of said mulitiple fluid jets and forming a curvilinear impingement pattern.

3. A process for generating multiple fluid jet streams in a spirally convergent/divergent arrangement according to claim 2 comprising passing said fluid jet stream through at least two fluid orifice means oriented at a compound angle having a spiral angular component of from about 5° to about 45° and a convergent angular component of from about 1° to about 30° with respect to said nozzle assembly central longitudinal axis.

4. A process for generating multiple fluid jet streams in a spirally convergent/divergent arrangement according to claim 3 additionally comprising intercepting the path of said fluid jet stream with at least one discontinuity generator means prior to passage of said fluid jet stream through said at least two fluid orifice means.

5. A process for generating multiple fluid jet streams in a spirally convergent/divergent arrangement according to claim 4 additionally comprising introducing and mixing solid particulates with said fluid jet streams downstream from said at least two fluid orifice means.

6. A process for generating multiple fluid jet streams in a spirally convergent/divergent arrangement according to claim 2 additionally comprising intercepting the path of said fluid jet stream with at least one discontinuity generator means prior to passage of said fluid jet stream thorugh said at least two fluid orifice means.

7. A process for generating multiple fluid jet streams in a spirally convergent/divergent arrangement according to claim 2 additionally comprising introducing and mixing solid particulates with said fluid jet streams downstream from said at least two fluid orifice means.

8. A nozzle assembly apparatus for generating multiple fluid jet streams in a spirally convergent/divergent arrangement according to claim 1 additionally comprising a nozzle body aligned with said nozzle assembly central longitudinal axis and supporting said fluid inlet tube and said fluid orifice means, and an orifice support cone providing said at least two fluid orifice means.

9. A nozzle assembly apparatus for generating multiple fluid jet streams in a spirally convergent/divergent arrangement according to claim 8 additionally comprising a gland nut having a central bore mounted on said nozzle body with said fluid inlet tube passing through said central bore and a cylindrical collar immediately downstream from said gland nut threadedly engaged with said fluid inlet tube.

10. A nozzle assembly apparatus for generating multiple fluid jet streams in a spirally convergent/divergent arrangement according to claim 8 wherein said nozzle body and said orifice support cone are in abutting and sealing relationship to form a fluid-tight convex/concave seal.

11. A nozzle assembly apparatus for generating multiple fluid jet streams in a spirally convergent/divergent arrangement according to claim 1 comprising about 2 to about 9 fluid orifice means.

12. A nozzle assembly apparatus for generating multiple fluid jet streams in a spirally convergent/divergent arrangement according to claim 11 comprising about 3 to about 6 fluid orifice means.

13. A nozzle assembly apparatus for generating multiple fluid jet streams in a spirally convergent/divergent arrangement according to claim 1 wherein said spiral angular component is from about 5° to about 45°.

14. A nozzle assembly apparatus for generating multiple fluid jet streams in a spirally convergent/divergent arrangement according to claim 13 wherein said convergent angular component is from about 1° to about 30°.

15. A nozzle assembly apparatus for generating multiple fluid jet streams in a spirally convergent/divergent arrangement according to claim 1 wherein said convergent angular component is from about 1° to about 30°.

16. A nozzle assembly apparatus for generating multiple fluid jet streams in a spirally convergent/divergent arrangement according to claim 1 additionally comprising a discontinuity generator means aligned with said nozzle assembly central longitudinal axis, said discontinuity generator means upstream from and adjacent said fluid orifice means.

17. A nozzle assembly apparatus for generating multiple fluid jet streams in a spirally convergent/divergent arrangement according to claim 8 additionally comprising at least one particulate feed means penetrating said nozzle body downstream from said fluid orifice means.

18. A nozzle assembly apparatus for generating multiple fluid jet streams in a spirally convergent/divergent arrangement according to claim 8 wherein said fluid orifice means comprise multiple orifice plates supported in multiple orifice plate receptacles in said orifice support cone, and multiple through passages in said orifice support cone aligned with said orifice plates, said orifice plates and said through passages being arranged at said compound angle.

19. A nozzle assembly apparatus for generating multiple fluid jet streams in a spirally convergent/divergent arrangement according to claim 1 wherein said fluid orifice means are provided in a circular pattern concentric with said nozzle assembly central longitudinal axis and have equal angular spacing.

20. A nozzle assembly apparatus for generating multiple fluid jet streams in a spirally convergent/divergent arrangement according to claim 1, additionally comprising a flow shaping cone downstream from said orifice means, said cone having a through passage having a tapered decreasing diameter in at least its upper portion.

21. A process for generating multiple fluid jet streams in a spirally convergent/divergent arrangement according to claim 2, additionally comprising passing said multiple fluid jets through a flow shaping cone downstream from said orifice means, said cone having a through passage having a tapered decreasing diameter in at least its upper portion.

* * * * *